United States Patent [19]

Horvay et al.

[11] 4,058,989

[45] Nov. 22, 1977

[54] REFRIGERATOR INCLUDING AIR WALL SEPARATING THE FREEZER AND FRESH FOOD PORTIONS

[75] Inventors: Julius B. Horvay; Robert J. Alvarez, both of Louisville, Ky.

[73] Assignee: General Electric Company, Louisville, Ky.

[21] Appl. No.: 642,683

[22] Filed: Dec. 22, 1975

[51] Int. Cl.[2] ..... A47F 3/04; F25D 11/02; F24F 9/00

[52] U.S. Cl. ..... 62/256; 62/441; 98/36

[58] Field of Search ..... 62/256, 405, 441; 98/36

[56] References Cited

U.S. PATENT DOCUMENTS

| | | | |
|---|---|---|---|
| 3,063,253 | 11/1962 | Dickson et al. | 62/256 |
| 3,123,988 | 3/1964 | Richman | 62/256 |
| 3,125,864 | 3/1964 | Ural | 62/256 |
| 3,143,952 | 8/1964 | Simons | 98/36 |
| 3,233,422 | 2/1966 | Kobrin | 62/441 |
| 3,359,751 | 12/1967 | Stevens | 62/441 |
| 3,392,544 | 7/1968 | Perez | 62/256 |
| 3,403,533 | 10/1968 | Bollenbacher | 62/441 |
| 3,698,205 | 10/1972 | Perez | 62/256 |

*Primary Examiner*—Lloyd L. King
*Attorney, Agent, or Firm*—Steven C. Schnedler; Francis H. Boos

[57] ABSTRACT

A household refrigerator has a compartment divided into a freezer portion and a fresh food portion. Instead of a solid partition, a moving invisible layer of air isolates the two portions from each other.

7 Claims, 5 Drawing Figures

FIG. 1
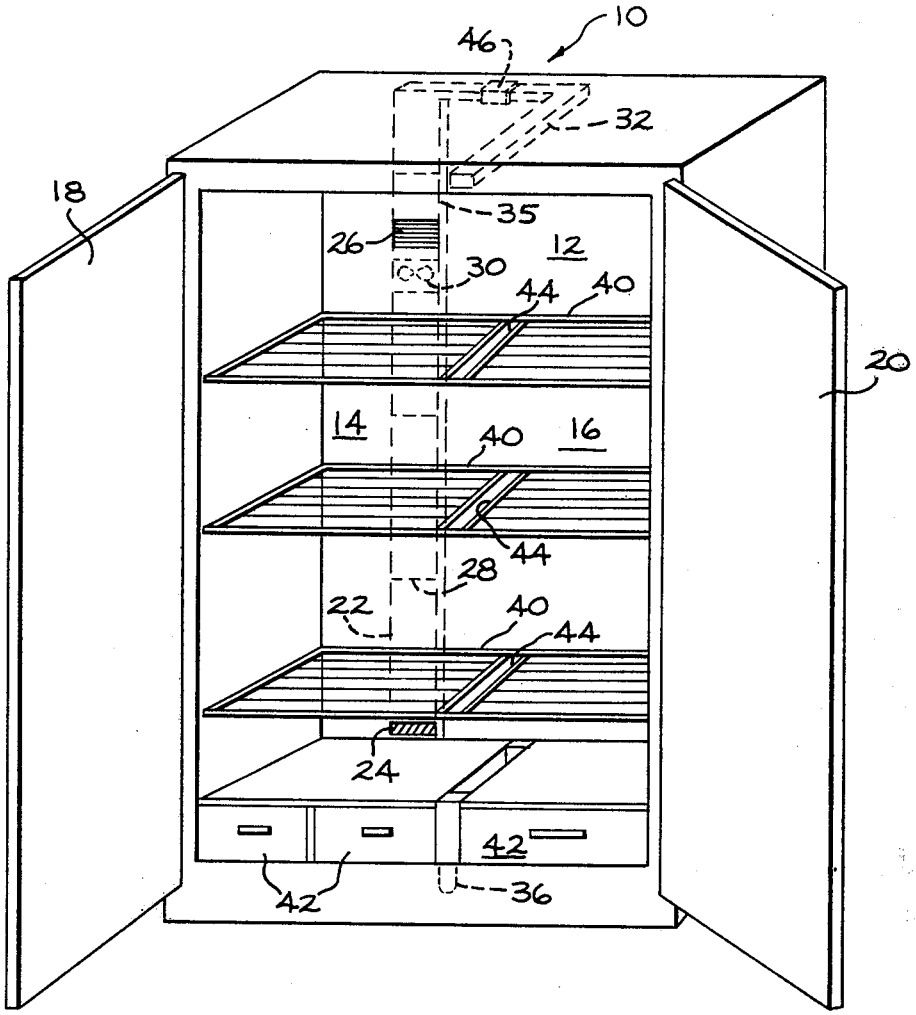
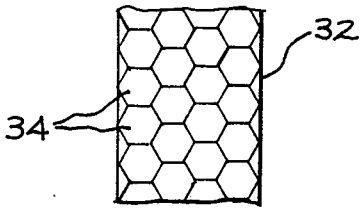
FIG. 3A

REFRIGERATOR INCLUDING AIR WALL SEPARATING THE FREEZER AND FRESH FOOD PORTIONS

BACKGROUND OF THE INVENTION

1. Field of the Invention

The present invention relates to household refrigerators and, more particularly, to a means for separating the freezer and fresh food portions of a refrigerator.

2. Description of the Prior Art

Conventional household refrigerators are divided into freezer and fresh food compartments or portions by a solid partition. The partition is generally formed of insulating material.

In a refrigerator which includes such a solid insulated partition, the compartments can appear to be unduly narrow and deep. This is particularly true for a side-by-side model in which the freezer and fresh food compartment each extend substantially from the top to the bottom of the refrigerator and are located side by side. The partition additionally complicates the interior lighting of the refrigerator since separate lamps must be provided for each compartment. Further, construction of the insulating partition involves labor and equipment.

It is therefore desirable to provide a means for maintaining the freezer and fresh food portions of the refrigerator at different temperatures while eliminating the solid insulating partition between the two compartments or portions.

SUMMARY OF THE INVENTION

In accordance with the broader aspects of the present invention, a household refrigerator has a compartment divided into a freezer portion and a fresh food portion. Instead of a solid partition, a moving invisible layer of air isolates the two portions from each other. To accomplish this, the refrigerator includes a means for passing a substantially laminar stream of air through the compartment to form a planar boundary between the portions. Means are included for cooling the freezer portion and leakage of some of the cold air from the freezer portion through the planar boundary cools the fresh food portion. Additionally, if refrigerated air is used for the laminar air stream, at the outer boundaries of the air stream, some of the refrigerated air "peels" off into the two portions to provide additional cooling.

In one embodiment of the present invention, the means for cooling the freezer portion includes an air channel having an inlet and an outlet, both opening in communication with the freezer portion, a refrigeration evaporator positioned in the air channel, and a fan for circulating air through the channel in heat exchange relationship with the evaporator, through the outlet, through the freezer portion, and through the inlet back to the air channel. The means for passing a substantially laminar stream of air through the compartment includes an air conduit for receiving refrigerated air from the channel and for directing the laminar stream of air across the compartment to an opposed wall of the compartment. An air receiving element extends substantially across the opposed wall and is adapted to receive the laminar air stream. A means for conducting air from the air receiving element back to the air conduit is also included.

BRIEF DESCRIPTION OF THE DRAWINGS

While the novel features of the invention are set forth with particularity in the appended claims, the invention, both as to organization and to content, will be better understood and appreciated, along with other objects and features thereof, from the following detailed description taken in conjunction with the drawings, in which:

FIG. 1 is a perspective view of a side-by-side refrigerator which includes means for passing a substantially laminar stream of air through the compartment to form a planar boundary between the freezer and fresh food portions.

FIG. 3A is an enlarged view of the openings in the air conduit shown in FIG. 3.

DESCRIPTION OF THE PREFERRED EMBODIMENTS

Figure 2:
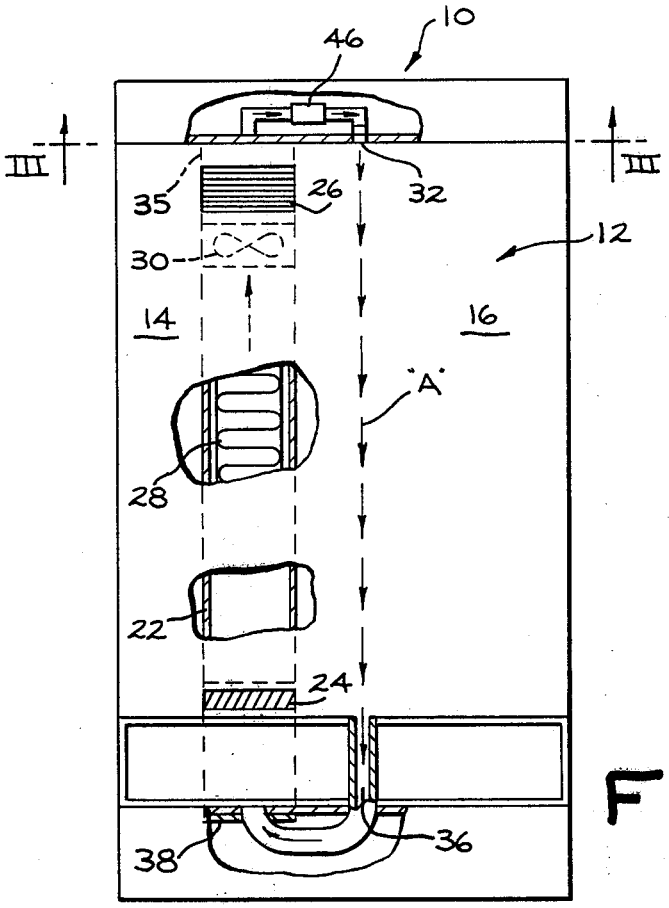
FIG. 2 is a diagrammatic frontal view in partial section of a portion of the refrigerator shown in FIG. 1.
Figure 3:
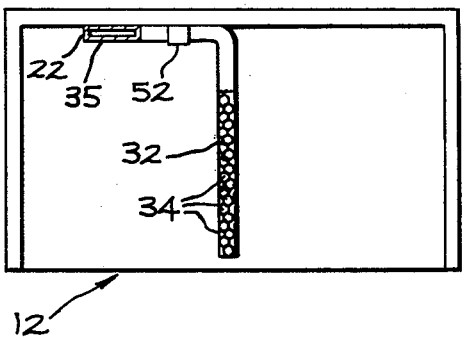
FIG. 3 is a diagrammatic, partially sectioned view taken along lines III—III of FIG. 2.

Referring first to FIGS. 1, 2, 3 and 3A, there is shown a household refrigerator 10 having a food compartment 12 divided into a freezer portion 14 and a fresh food portion 16. Conventional doors 18 and 20 define the front of the food compartment 12 when closed.

The refrigerator 10 includes a means for cooling the freezer portion 14, which means includes a first air channel 22 having an inlet 24 for receiving air from the freezer portion 14 and an outlet 26 for discharging refrigerated air into the freezer portion 14. An evaporator 28 is positioned in the air channel 22 between the inlet 24 and the outlet 26, and is a part of a conventional closed circuit refrigerator system (not shown). The means for cooling the freezer portion 14 further includes a fan 30 (broken lines) for circulating air through the first air channel 22 in heat exchange relationship with the evaporator 28, through the outlet 26, through the freezer portion 14, and through the inlet 24 back to the air channel 22.

In accordance with the present invention, the refrigerator 10 includes a means for passing a substantially laminar stream of air (designated "A" in FIG. 2) through the compartment 14 to form a planar boundary between the freezer and the fresh food portions 14 and 16. In the illustrated embodiment, this means includes a first air conduit 32 which extends from front to rear substantially completely across the top of the food compartment 12. A multiplicity of openings 34 extend along the length of the conduit 32 and are oriented for directing the laminar stream of air "A" substantially completely across and through the food compartment 12 to an opposed wall of the compartment. The opposed wall is shown as the bottom of the refrigerator compartment 12. The air conduit 32 thus defines an interface between the planar boundary formed by the laminar air stream and the top wall of the food compartment 12. In order to supply refrigerated air to the first air conduit 32, one end of the conduit 32 is connected to a discharge end 35 of the first air channel 22 for receiving air therefrom.

The means for passing a substantially laminar stream of air through the compartment 12 further includes a first air receiving element 36 extending substantially completely across the opposed wall of the compartment 12. The air receiving element 36 thus defines an interface between the planar boundary and the bottom of the refrigerator 10. The air receiving element 36 is connected to an inlet end 38 of the air channel 22 to return air back to the first air channel 22, thereby forming a complete air circulation system.

Food shelves 40 and the vegetable pan 42 are of a construction which provides an unobstructed air pathway across the compartment 12 so as to not break up the laminar flow characteristics of the air stream. Referring particularly to FIG. 1, an unobstructed pathway for the laminar air stream is maintained by providing aligned slotted openings 44 in the food shelves 40 and by positioning the air receiving element 36 between adjacent vegetable pans 42 in alignment with the slotted openings 44.

Since the laminar air stream "A" provides the thermal barrier and separation between the freezing and fresh food portions 14 and 16, it will be understood that this barrier should be maintained by continuously operating the fan 30.

The inlet 24 and the outlet 26 of the air channel 22 can be of a preselected size or can each have a baffle or valve system positioned therein for controlling the air flow rate through the channel 22.

The air stream "A" can be maintained in laminar flow by controlling the discharge rate of the air stream from the air conduit 32, as is known in the art of fluid mechanics. A preselected discharge rate can be maintained by an adjustable baffle 46 or by controlling the size of the openings 34 in the air conduit 32. The openings 34 are a honeycomb of hexagonal nozzles, each about 3 inches in length.

In the operation of the embodiment shown in FIGS. 1, 2, 3 and 3A, the laminar flow air stream "A" forms an effective thermal barrier between the freezer and fresh food portions 14 and 16. This permits the freezer portion 14 to be maintained within a temperature range of from about −17° C, to −14° C, and the fresh food portion 16 within a range from about 1° C to 9° C. In the embodiment illustrated in FIGS. 1, 2, 3 and 3A, cooling of the fresh food portion 16 is through leakage of cold air from the freezer 14 across the laminar air stream "A" and additionally by "peeling" off of a boundary layer of the laminar air stream. The degree of cooling of the fresh food portion 16 can be adjusted to some extent by varying the width of the slotted openings 44 so that more or less of the laminar air stream is deflected or "peeled off" into the fresh food portion 16. Additional air deflecting elements could be placed along the edge of the slotted openings for further directing of refrigerated air from the laminar stream into the fresh food portion 16.

Figure 4:
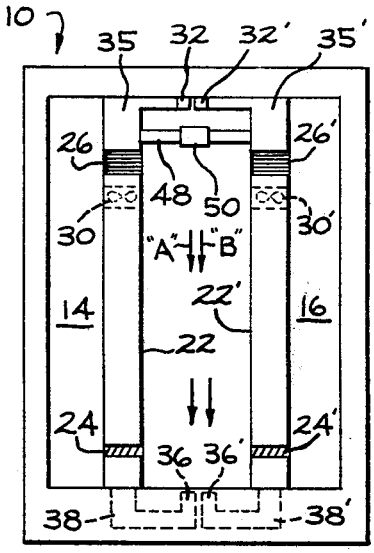
FIG. 4 is a diagrammatic frontal view of a refrigerator constructed in accordance with another embodiment of the present invention.

Referring now to FIG. 4, an alternative embodiment of the present invention is shown. The refrigerator 10 shown in FIG. 4 is similar in construction to the refrigerator 10 in FIG. 1 with the exception that a second air channel 22' is provided and positioned in the fresh food portion 16. The second air channel 22' is connected to a second air conduit 32' for passing a second substantially laminar stream of air "B" through the compartment 12 along the first laminar stream of air "A" and in a common direction relative thereto. Also connected to the second air channel 22' is a second air receiving element 36'. A second air circulating system, comprising the second air channel 22' and its associated means for passing a second laminar air stream through the compartment 12, provides the system with additional temperature control. No evaporator need be placed within the second air channel 22' because there is sufficient intermixing of air to cool the fresh food portion.

Preferably, for better temperature control, a bypass conduit 48 is connected for fluid communication between the first and second air channels 22 and 22'. The bypass conduit 48 increases the interchange of air between the freezing and fresh food portions 14 and 16. In order to control the air flow through the bypass conduit 48, a control means, such as a baffle 50, is included. Other details in, and the operation of, the embodiment of FIG. 4 are substantially identical to those of the embodiment illustrated in and described with reference to FIGS. 1, 2, 3 and 3A, so a detailed description will not be repeated.

The present invention, therefore, provides a two-compartment refrigerator which eliminates the physical partition between the two compartments. Improved appearance results and the cost of constructing a solid insulated partition is eliminated. Since the entire refrigerator 10 is still contained within a solidly insulated box, the total refrigeration requirements, and thus energy requirements, of the system are not substantially increased.

While specific embodiments of the invention have been illustrated and described herein, it is realized that numerous modifications and changes will occur to those skilled in the art. It is to be understood that the appended claims are intended to cover all such modifications and changes as follows in the true spirit and scope of the invention.

What is claimed is:

1. A household refrigerator of the side-by-side type comprising:

a. a food compartment including a freezer portion and a fresh food portion, said compartment being defined by a solid insulated box having a solid insulated access door and constructed so that the interior thereof is physically isolated from ambient air when the door is closed;

b. means for cooling said freezer portion; and c. means for passing a first substantially laminar stream of air through said compartment to form an invisible planar boundary between said portions, said means including:

a first air conduit extending substantially across one of the walls of said compartment to define an interface between the planar boundary and said one of the walls, said first air conduit having at least one opening for directing the first laminar stream of air across said compartment to an opposed wall of said compartment, a first air-receiving element extending substantially across said opposed wall to define an interface between the planar boundary and said opposed wall, said first receiving element serving to receive said first laminar stream of air, and means for recirculating air from said first receiving element to said first air conduit.

2. A refrigerator according to claim 1, wherein said means for cooling said freezer portion includes:

a. a first air channel having an inlet and an outlet opening in communication with said freezer portion;

b. an evaporator positioned in said first air channel between said inlet and said outlet; and c. a fan for circulating air through said first channel in heat exchange relationship with said evaporator, through said outlet, through said freezer portion, and through said inlet back to said first channel; and wherein said first air conduit receives refrigerated air from said first air channel, and air from said first air-receiving element returns to said first air channel.

3. A refrigerator according to claim 2, further comprising:

a. a second air channel having an inlet and an outlet opening in communication with said fresh food portion;

b. a fan for circulating air through said second air channel, through said outlet of said second air channel, through said fresh food portion, and through said inlet of said second air channel back to said second air channel;

c. a second air conduit for receiving air from said second air channel and for directing a second substantially laminar stream of air along said first laminar stream of air and in a common direction relative thereto;

d. a second air-receiving element serving to receive said second laminar stream of air; and e. means for conducting air from said second air-receiving element to said second air conduit.

4. A refrigerator according to claim 3, further comprising a bypass conduit for fluid communication between said first and second air channels.

5. A refrigerator according to claim 4, further comprising a means for controlling the rate of airflow through said bypass conduit.

6. A refrigerator according to claim 1, wherein said means for passing a first substantially laminar stream of air through said compartment is supplied with refrigerated air, and a portion of the boundary layer of said first laminar air stream tends to peel off to provide cooling of said fresh food portion.

7. A household refrigerator of the side-by-side type comprising:

a. a food compartment including a freezer portion and a fresh food portion, said compartment being defined by a solid insulated box having a solid insulated access door and constructed so that the interior thereof is physically isolated from ambient air when the door is closed;

b. means for cooling said freezer portion;

c. means for passing a first substantially laminar stream of air through said compartment to form an invisible planar boundary between said portions, said means for passing a first substantially laminar stream of air through said compartment being supplied with refrigerated air and a portion of the boundary layer of said first laminar air stream tending to peel off to provide cooling of said fresh food portion; and d. food shelves having slotted openings aligned so as to provide a substantially unobstructed pathway for said laminar air stream, the edges of said slotted food shelf openings serving to deflect additional cool air into said fresh food portion.

* * * * *